US008166983B2

(12) United States Patent
Clerkin

(10) Patent No.: US 8,166,983 B2
(45) Date of Patent: May 1, 2012

(54) FLUID SUPPLY SYSTEM FOR APPLIANCE

(75) Inventor: Colin R. Clerkin, Waunakee, WI (US)

(73) Assignee: Wolf Appliance, Inc., Fitchburg, WI (US)

( * ) Notice: Subject to any disclaimer, the term of this patent is extended or adjusted under 35 U.S.C. 154(b) by 1153 days.

(21) Appl. No.: 11/963,660

(22) Filed: Dec. 21, 2007

(65) Prior Publication Data

US 2009/0159101 A1 Jun. 25, 2009

(51) Int. Cl.
*A47L 15/42* (2006.01)
*A47L 15/14* (2006.01)
*B08B 3/04* (2006.01)

(52) U.S. Cl. ..... 134/44; 134/56 D; 134/57 D; 134/58 D

(58) Field of Classification Search ..... 134/44, 134/56 D, 57 D, 58 D
See application file for complete search history.

(56) References Cited

U.S. PATENT DOCUMENTS

| | | | |
|---|---|---|---|
| 2,013,387 | A | 9/1935 | Johnston |
| 2,704,083 | A | 3/1955 | Low |
| 3,370,869 | A | 2/1968 | Dutcher |
| 3,809,106 | A | 5/1974 | Crabtree |
| 3,866,837 | A | 2/1975 | Jenkins |
| 3,876,148 | A | 4/1975 | Cushing et al. |
| 3,941,139 | A | 3/1976 | Spiegel |
| 3,951,684 | A | 4/1976 | LaPrad et al. |
| 4,014,467 | A | 3/1977 | Ferguson |
| 4,064,887 | A | 12/1977 | Geiger et al. |
| 4,172,463 | A | 10/1979 | Woolley et al. |
| 4,418,868 | A | 12/1983 | Gurubatham et al. |
| 4,443,028 | A | 4/1984 | Hayes |
| 4,732,171 | A | 3/1988 | Milocco |
| 4,869,428 | A | 9/1989 | Gombar |
| 4,884,585 | A | 12/1989 | Oh |
| 4,991,611 | A | 2/1991 | Jarvis et al. |
| 5,165,435 | A | 11/1992 | Thies et al. |
| 5,211,190 | A | 5/1993 | Johnson et al. |
| 5,267,582 | A | 12/1993 | Purtilo |
| 5,330,102 | A | 7/1994 | Jarvis et al. |
| 5,333,631 | A | 8/1994 | Kirkland et al. |
| 5,433,228 | A | 7/1995 | Dingler |
| 5,474,378 | A | 12/1995 | Smith et al. |

(Continued)

FOREIGN PATENT DOCUMENTS

| | | |
|---|---|---|
| DE | 2730611 | 8/1978 |

(Continued)

*Primary Examiner* — Joseph L Perrin
*Assistant Examiner* — Benjamin Osterhout
(74) *Attorney, Agent, or Firm* — Bell & Manning, LLC

(57) ABSTRACT

A dishwasher includes a tub formed by a plurality of walls defining an interior and an exterior, a first conduit coupled to the tub, a valve coupled to the first conduit, a rack moveable between an engaged horizontal position and a disengaged horizontal position and between an upper vertical position and a lower vertical position, and a second conduit coupled to the rack. A first portion of the second conduit engages the valve when the rack is in the upper vertical position, and a second portion of the second conduit engages the valve when the rack is in the lower vertical position. The valve permits fluid to flow from the first conduit to the second conduit when the rack is in the engaged horizontal position. The valve does not permit fluid to flow from the first conduit to the interior when the rack is in the disengaged horizontal position.

21 Claims, 10 Drawing Sheets

U.S. PATENT DOCUMENTS 5,480,035 A 1/1996 Smith
5,488,965 A 2/1996 Hori
5,560,381 A 10/1996 Edwards
5,595,200 A 1/1997 Favaro
5,609,174 A 3/1997 Ferguson
5,655,556 A 8/1997 Guerrera et al.
5,657,878 A 8/1997 Austin
5,662,744 A 9/1997 Tuller et al.
5,725,002 A 3/1998 Payzant
5,730,805 A 3/1998 Bertsch et al.
5,752,533 A 5/1998 Edwards
5,823,211 A 10/1998 Wilhelmstätter et al.
5,842,492 A 12/1998 Lee
5,860,716 A 1/1999 Good et al.
5,899,433 A * 5/1999 Kim et al. ..... 251/30.01
5,904,166 A 5/1999 Nannt et al.
5,937,880 A * 8/1999 Payzant ..... 134/175
5,954,073 A 9/1999 Tobbe et al.
5,964,232 A 10/1999 Chung
6,044,853 A 4/2000 Payzant
6,325,083 B1 12/2001 Wörter
6,357,460 B1 3/2002 Bertsch et al.
6,431,188 B1 8/2002 Laszczewski, Jr. et al.
6,612,009 B1 9/2003 Laszczewski, Jr. et al.
6,641,058 B2 11/2003 Hegeman et al.
6,662,814 B2 12/2003 Tobbe et al.
6,705,330 B1 * 3/2004 Favret ..... 134/56 D
6,755,490 B2 6/2004 Welch et al.
6,869,029 B2 3/2005 Ochoa, Sr. et al.
7,032,604 B2 4/2006 Welch
7,055,537 B2 6/2006 Elick et al.
7,114,509 B2 * 10/2006 Favret ..... 134/169 R
7,168,578 B2 1/2007 Mersch et al.
7,210,489 B2 5/2007 Eiermann
2003/0005950 A1 1/2003 Tobbe et al.
2003/0183255 A1 10/2003 Kim et al.
2004/0000331 A1 * 1/2004 Elick et al. ..... 134/180
2004/0103932 A1 6/2004 Kim
2004/0112412 A1 * 6/2004 Han et al. ..... 134/58 D
2004/0163685 A1 8/2004 Roh
2004/0163687 A1 8/2004 Son et al.
2004/0255982 A1 12/2004 VanderRoest et al.
2005/0001524 A1 1/2005 Deiss et al.
2005/0039782 A1 2/2005 Kim
2005/0081897 A1 4/2005 Pardini
2005/0150528 A1 7/2005 Kim
2005/0178414 A1 8/2005 Kang
2006/0185700 A1 8/2006 Lee
2006/0237042 A1 10/2006 Weaver et al.
2006/0249181 A1 * 11/2006 Wetzel et al. ..... 134/25.1
2006/0278258 A1 12/2006 Kara et al.
2007/0006903 A1 1/2007 Koch et al.
2007/0056613 A1 3/2007 Haas et al.
2007/0079850 A1 4/2007 Jerg et al.
2007/0215187 A1 9/2007 Koch et al.

FOREIGN PATENT DOCUMENTS

DE 2732540 2/1979
DE 2732665 2/1979
DE 3125853 4/1983
DE 3732453 4/1989
EP 0401767 1/1994
GB 1514653 9/1976
GB 2001522 2/1979
GB 2001523 2/1979
GB 2210257 6/1989
WO WO 83/01892 6/1983

* cited by examiner

FLUID SUPPLY SYSTEM FOR APPLIANCE

BACKGROUND

The present invention relates generally to the field of appliances, and more specifically, to a dishwashing appliance having a fluid supply system for supplying a fluid to one or more spray assemblies.

Typically, appliances such as dishwashers are provided with an interior wash chamber or tub, and have one or more racks, or baskets, that are designed to hold dishware within the interior of the tub during operation of the dishwasher.

In order to effectively clean the dishware, one or more spray assemblies is typically provided. Each spray assembly typically includes a rotating spray arm that is fluidly connected to a pump. The pump supplies fluid to the spray arm, which in turn sprays dishwashing fluid or water onto the dishware in the rack(s).

Some racks may support a spray assembly and may also be adjustable horizontally and/or vertically relative to the tub. Complex coupling features and additional components are typically required to properly couple the spray assemblies to the fluid supply system and permit proper functioning of the dishwasher should a user wish to adjust or remove one or more racks.

Accordingly, it would be advantageous to provide a dishwasher having a fluid supply system that includes a simple coupling for providing fluid to an adjustable-height and removable rack.

SUMMARY

One embodiment relates to a dishwasher comprising a tub formed by a plurality of walls defining an interior and an exterior, a first conduit coupled to the tub, a valve coupled to the first conduit, a rack moveable between an engaged horizontal position and a disengaged horizontal position and moveable between an upper vertical position and a lower vertical position, and a second conduit coupled to the rack, wherein a first portion of the second conduit is configured to engage the valve when the rack is in the upper vertical position and a second portion of the second conduit is configured to engage the valve when the rack is in the lower vertical position, and wherein the valve permits fluid to flow from the first conduit to the second conduit when the rack is in the engaged horizontal position, and wherein the valve does not permit fluid to flow from the first conduit to the interior when the rack is in the disengaged horizontal position.

Another embodiment relates to a fluid supply system for an appliance, comprising a conduit having an outlet, and a spray assembly having an inlet selectively engaged with the outlet, wherein the outlet is configured to engage the inlet at a first position of the inlet when the spray assembly is in an upper position and at a second position of the inlet when the spray assembly is in a lower position, wherein the outlet permits fluid to flow from the outlet to the inlet when the inlet engages the outlet, and wherein the outlet does not permit fluid to flow from the outlet to the inlet when the inlet is disengaged from the outlet.

Yet another embodiment relates to an appliance comprising a tub having an interior, a conduit coupled to the tub, the conduit having an outlet and a ball that is moveable between a first position and a second position such that the ball permits a fluid to exit the outlet only when the ball is in the second position, and a spray member for providing the fluid to the interior and having an inlet and being removably coupled with the outlet to receive the fluid from the outlet, the spray member including a first projection and a second projection that selectively interface with the ball such that the ball is in the first position when the inlet is not coupled with the outlet, and the ball is moved to the second position when the inlet is coupled with the outlet.

Yet another embodiment relates to a dishwasher comprising a tub, a wash pump coupled to the tub, a rack moveable between a first horizontal position and a second horizontal position, a spray arm assembly removably coupled to the rack and comprising a spray arm and a first conduit, and a second conduit located at the exterior of the tub that fluidly couples the wash pump to the spray arm assembly, wherein the first conduit includes a first attachment feature that engages a first tine on a rear side of the rack and a second attachment feature that engages a second tine on the bottom side of the rack.

The invention is capable of other embodiments and of being practiced and carried out in various ways. Alternative exemplary embodiments relate to other features and combinations of features as may be generally recited in the claims.

BRIEF DESCRIPTION

DETAILED DESCRIPTION

Figure 1:
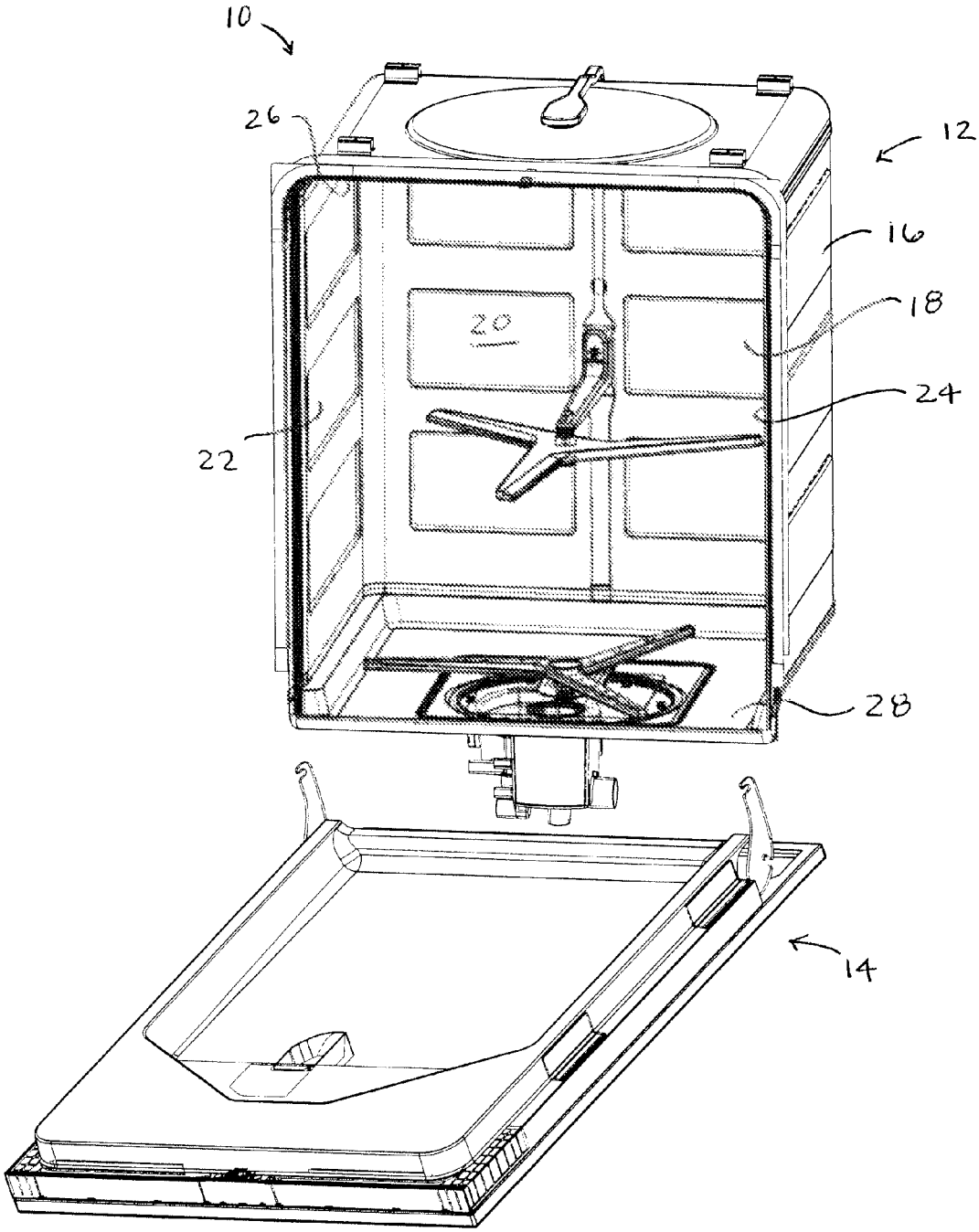
FIG. 1 is a perspective view of a dishwasher according to an exemplary embodiment.

Referring to FIG. 1, an appliance is shown as a dishwasher 10. Dishwasher 10 includes a body portion 12, and a door 14. Door 14 is pivotally attached to body portion 12 such that door 14 may be positioned in either an open position (e.g., during loading or unloading of dishware into one or more baskets used with dishwasher 10), or a closed position (e.g., during actual operation of the dishwasher or periods of non-use). It should be understood that dishwasher 10 may be provided in a variety of configurations, and door 14 and body 12 may be pivotally or otherwise coupled in various ways.

Referring further to FIG. 1, body portion 12 includes a tub 16 (e.g., a washing chamber, etc.). Tub 16 defines an interior portion 18 of dishwasher 10, and includes various wall portions, including a back wall 20, opposing sidewalls 22, 24, and top and bottom walls 26, 28.

Figure 2:
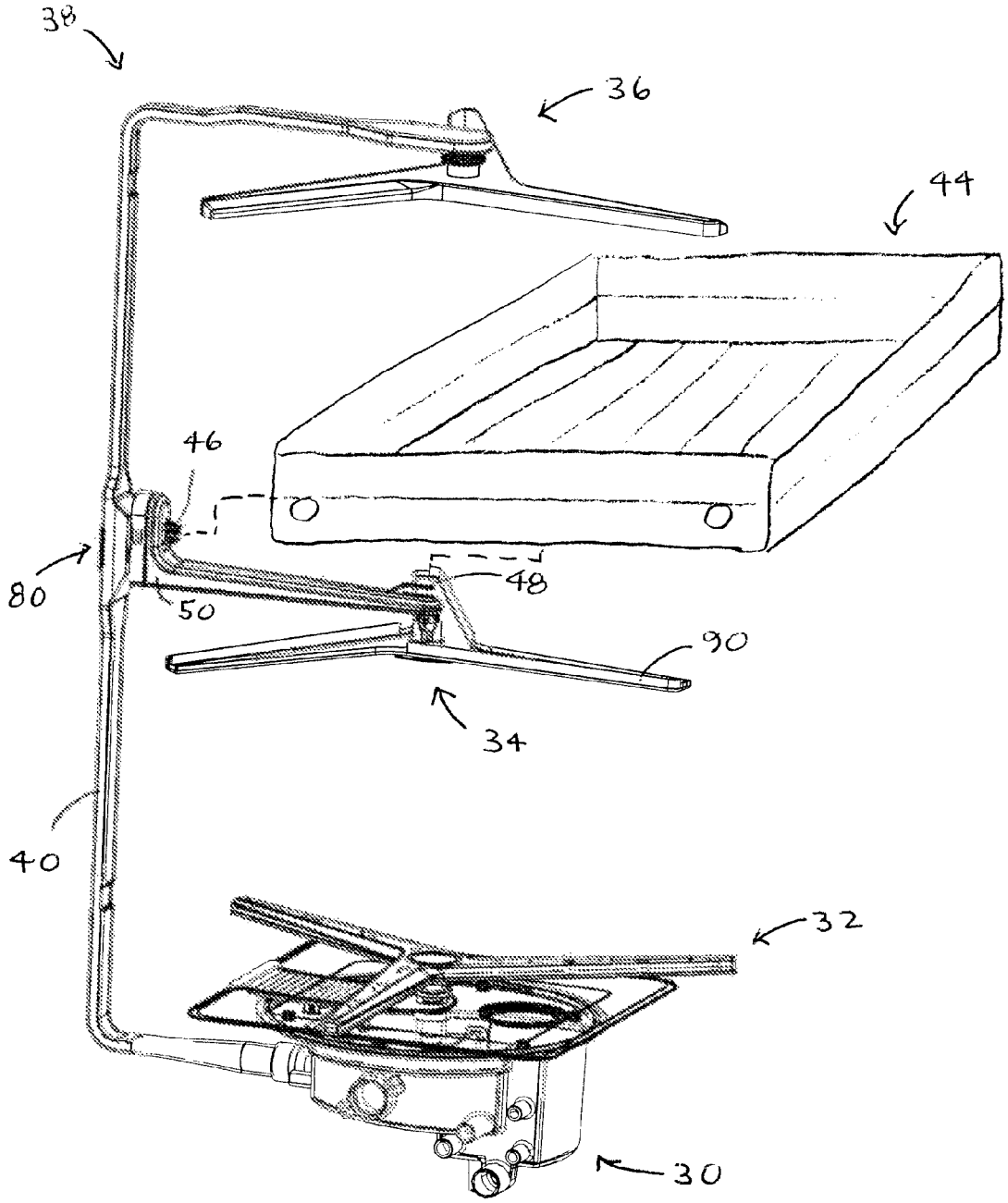
FIG. 2 is a perspective view of a fluid supply system and a rack according to an exemplary embodiment.

Referring now to FIG. 2, according to an exemplary embodiment, dishwasher 10 includes a fluid supply system 38. Fluid supply system 38 includes a pump 30 that supplies a fluid (e.g., water, dishwashing fluid, etc.) to one or more spray assemblies 32, 34, 36 (e.g., wash arms, etc.) via a conduit 40 (e.g., a feed tube, feed line, hose, channel, etc.). According to the embodiment illustrated in FIG. 2, dishwasher 10 includes a lower spray assembly 32, a middle spray assembly 34, and an upper spray assembly 36.

According to one embodiment, middle spray assembly 34 and upper spray assembly 36 receive fluid from pump 30 via conduit 40 that runs from pump 30 to middle spray assembly 34 and further to upper spray assembly 36. According to an exemplary embodiment, lower spray assembly 32 may be coupled to pump 30 without the need for additional conduits (e.g., tubes, feed lines, etc.) to transport the fluid to the spray assembly. According to another exemplary embodiment, spray assembly 32 may be configured such that it receives fluid from pump 30 via conduit 40.

Referring further to FIG. 2, dishwasher 10 includes one or more racks (e.g., baskets, supports, etc.) for holding dishware and other items to be washed using dishwasher 10. According to an exemplary embodiment, dishwasher 10 includes a lower rack, a middle rack 44, and an upper rack (for purposes of clarity, only middle rack 44 is shown in FIG. 2). Lower spray assembly 32, middle spray assembly 34, and upper spray assembly 36 are positioned such that they spray fluid supplied by pump 30 onto dishware held by the various racks. For example, as shown in FIG. 2, lower spray assembly 32 is located generally above pump 30 such that it sprays fluid upward onto dishware in the lower rack from below. Similarly, upper spray assembly 36 is coupled to top wall 26 such that it sprays fluid downward onto dishware in the upper rack from above. Middle spray assembly 34 is supported by middle rack 44 by one or more coupling features 46, 48 and is positioned to spray fluid upward onto dishware in middle rack 44 from below. According to various alternative exemplary embodiments, the various spray assemblies may be configured to spray fluid in other directions (e.g., upward, downward, etc.) than those discussed herein and more or fewer spray assemblies (e.g., 1, 2, 3, etc.) may be used.

Referring to FIG. 2 and with respect to middle spray assembly 34, during operation of dishwasher 10, fluid is pumped from pump 30, through conduit 40, and enters a valve 80 (e.g., a distribution manifold, a control portion, etc.). From valve 80, fluid is directed to a second conduit 50 (e.g., wash line, tube, feed line, etc.) which is fluidly coupled to a spray arm 90. According to an exemplary embodiment, spray arm 90 includes a number of arms or extensions, each having a plurality of apertures or holes therein, that distribute the fluid to the dishware within dishwasher 10. According to various exemplary embodiments, spray arm 90 may be configured to rotate during operation and may take a variety of shapes, sizes, and configurations to suit particular applications. The fluid that is sprayed out of spray arm 90 may then be collected in a reservoir at the bottom of tub 16 and, if desired, recirculated through fluid supply system 38 using pump 30.

Figure 3:
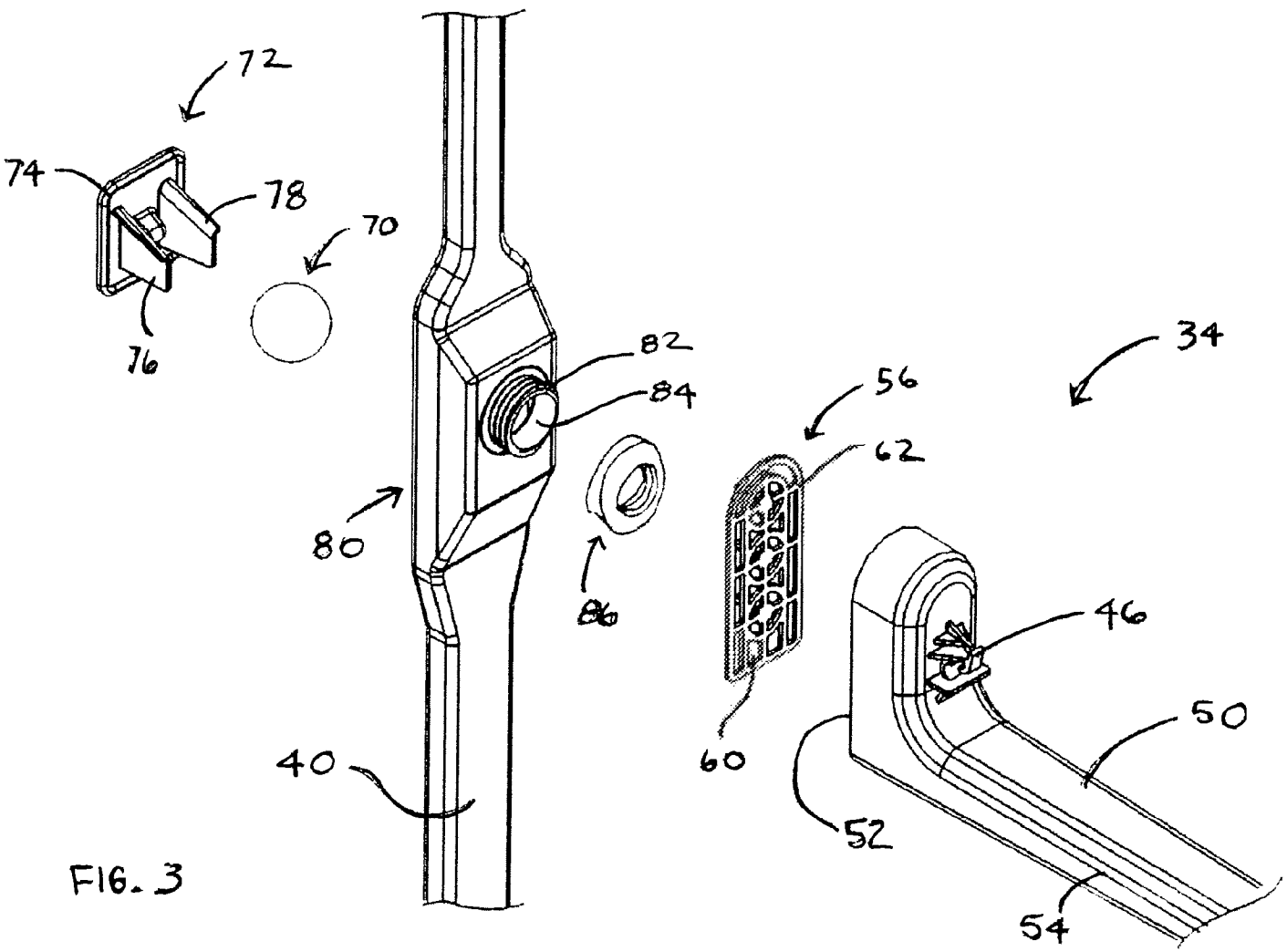
FIG. 3 is a partial exploded view of a portion of the fluid supply system shown in FIG. 2 according to an exemplary embodiment.

Referring to FIG. 3, a portion of fluid supply system 38 is shown in greater detail according to an exemplary embodiment. Conduit 40 extends from pump 30 (not shown in FIG. 3) to valve 80. Valve 80 forms a part of or is coupled to conduit 40 and is provided in the flow-path of fluid traveling through conduit 40. Valve 80 is configured to direct fluid to flow from valve 80 to spray assembly 34 and/or to direct the fluid past spray assembly 34 and to upper spray assembly 36 (not shown in FIG. 3).

As shown in FIG. 3, valve 80 comprises an inclined member or ramp, shown as a member 72, a ball member or ball 70, and a coupling portion 82 (e.g., an extension, protrusion, threaded member, post, etc.) that defines an aperture or outlet 84. A fastener 86 (e.g., a cap, nut, threaded member, etc.) is provided and is attached to coupling portion 82 after portion 82 passes through back wall 20 (not shown in FIG. 3 for clarity) of tub 16. According to an exemplary embodiment, one or more seals or washers may be provided on either side of tub wall 20 in order to provide a sealed interface between coupling portion 82, tub wall 20, and fastener 86.

According to an exemplary embodiment, member 72 is provided with a pair of inclined surfaces 76, 78 (e.g., extensions, ribs, rails, etc.) that extend from portion 74 and provide a support for ball 70. As shown in FIG. 3, surfaces 76, 78 are inclined downward toward outlet 84 such that surfaces 76, 78 tend to bias ball 70 toward outlet 84 when valve 80 is assembled. According to an exemplary embodiment, inclined surfaces 76, 78 are generally straight and flat inclined surfaces. According to an alternative exemplary embodiment, surfaces 76, 78 may comprise a curved surface. According to an exemplary embodiment, member 72 and ball 70 are made from a polymer material. According to various other exemplary embodiments, member 72 and ball 70 may be made from any suitable material (e.g., teflon, stainless steel, plastic-coated stainless steel, etc.). According to one exemplary embodiment, member 72 may have no incline, or a reverse incline relative to that shown in FIG. 3, and a separate biasing mechanism such as a spring may be used to bias ball 70 toward outlet 84. As shown in FIG. 3, member 72 is a separately formed component from conduit 40. According to another exemplary embodiment, member 72 may be provided as an integrally formed portion of conduit 40.

Figure 8:
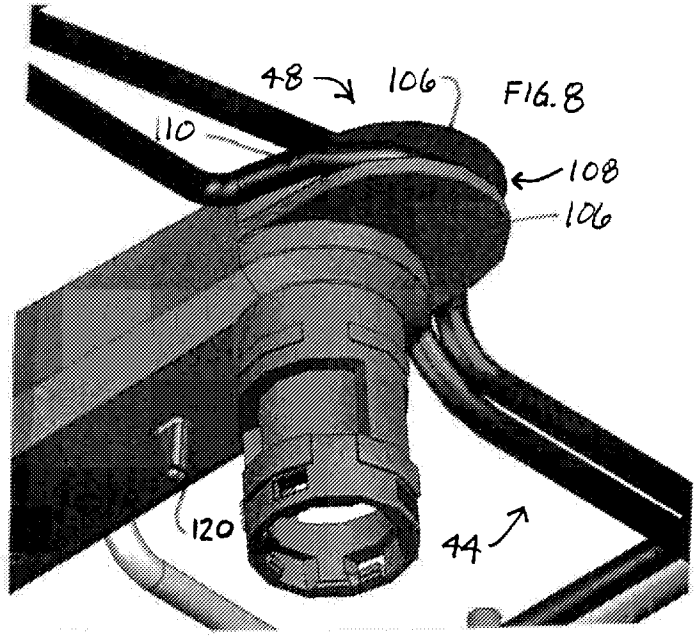
FIG. 8 is a perspective view of a portion of a dishwasher according to an exemplary embodiment.
Figure 9:
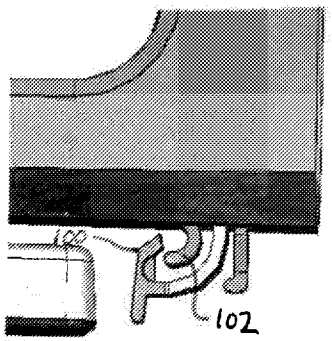
FIG. 9 is a perspective view of a portion of a dishwasher according to an exemplary embodiment.
Figure 7:
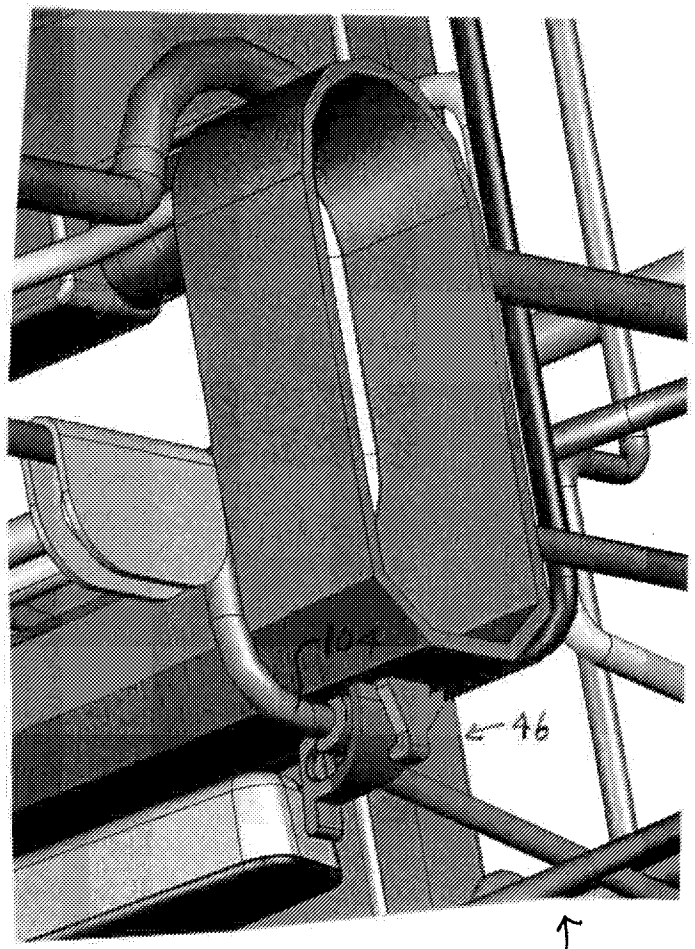
FIG. 7 is a perspective view of a portion of a dishwasher according to an exemplary embodiment.

Referring further to FIG. 3, a portion of second conduit 50 is shown and includes a channel 54 and an inlet 52 (e.g., an inlet portion, a shroud, a cover, etc.). One or more attachment features 46, 48 (see FIG. 2 for attachment feature 48) may be provided to secure spray assembly 34 to rack 44. Attachment features 46, 48 may include a wide variety of fasteners such as snap-fit fasteners, conventional mechanical fasteners such as screws, etc., and so on. Referring to FIG. 3, attachment feature 46 comprises a snap fit hook that couples to a horizontal wire on the rear of rack 44. Attachment feature 48 comprises a groove (recess, notch, etc.) that receives a wire on the bottom surface of rack 44. As such, second conduit 50 is easily removably coupled to rack 44 by first engaging attachment feature 48 with a bottom surface tine, and then snap coupling attachment feature 46 to a rear surface tine. FIGS. 7-9 show an exemplary embodiment of attachment features 46, 48. Attachment feature 46 comprises a curved hook member 100 and a catch member 102 that couple to a tine 104 on a rear side of rack 44 in a snap-fit engagement. Attachment feature 48 comprises a pair of projections 106 (ribs, members, etc.) that form a recess 108 (groove, notch, etc.). Recess 108 receives a tine 110 on the bottom side of rack 44.

Figure 4:
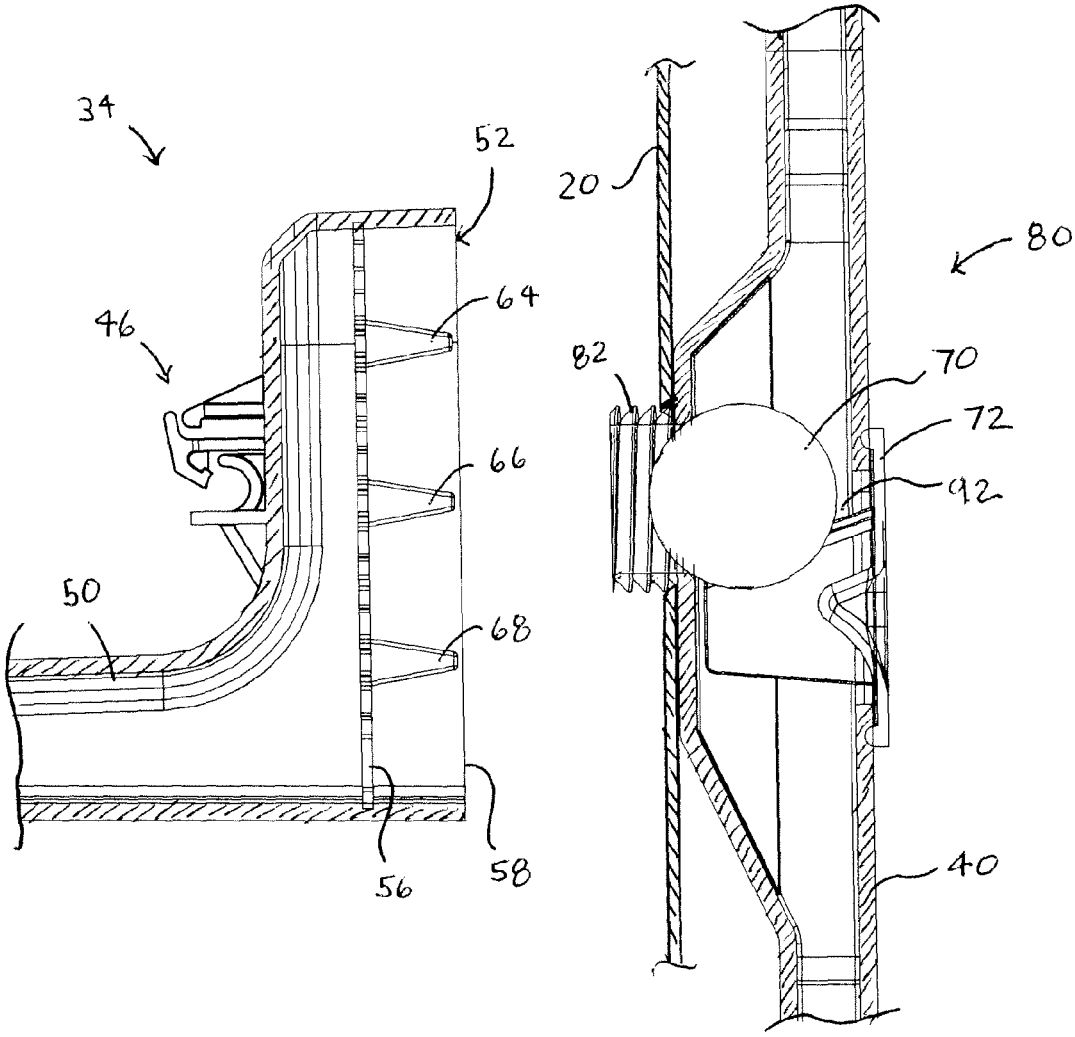
FIG. 4 is a partial cross-sectional view of the fluid supply system shown in FIG. 2 according to an exemplary embodiment.
Figure 5:
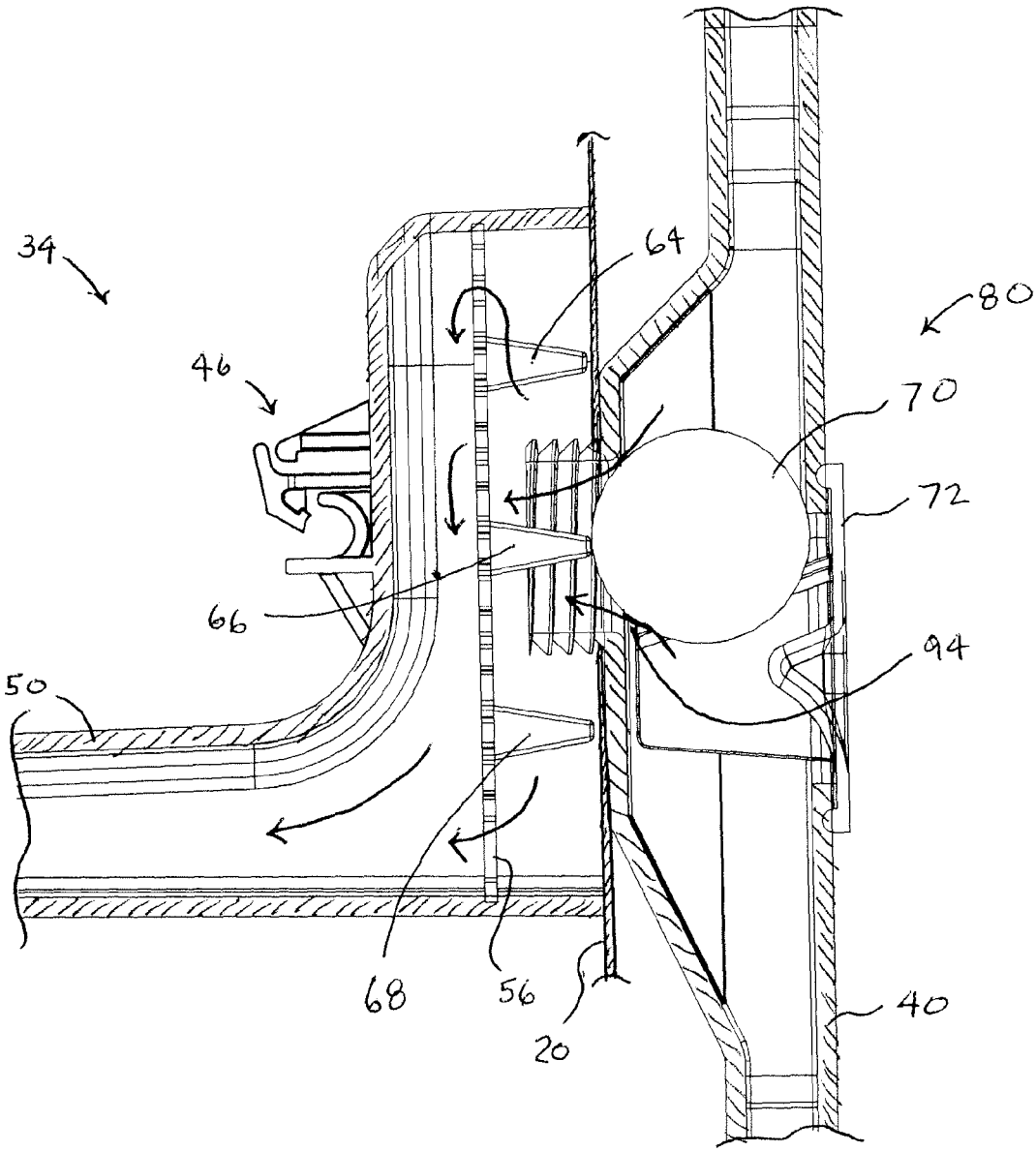
FIG. 5 is a partial cross-sectional view of the fluid supply system shown in FIG. 2 according to an exemplary embodiment.

Referring again to FIG. 3, inlet 52 is configured to fluidly couple with and receive fluid from outlet 84 when conduit 50 is coupled with valve 80. As shown in FIGS. 4 and 5, according to an exemplary embodiment inlet 52 is larger than outlet 84 such that inlet 52 may engage outlet 84 (and therefore valve 80) in at least two different positions (e.g., at least two different vertical positions). For example, as shown in FIGS. 4 and 5, inlet 52 is configured to engage valve 80 in three positions (each position corresponding to the position of one of projections 64, 66, 68). According to various alternative exemplary embodiments, inlet 52 may be configured to engage valve 80 in fewer or more positions (e.g., 1, 2, 4, etc.). According to an exemplary embodiment, because spray assembly 34 is coupled to and supported by rack 44, the vertical position of spray assembly 34 is determined by the vertical position of rack 44. The vertical position of rack 44 may be adjusted using a variety of methods (e.g., rails or guides on sidewalls 22, 24 that receive wheels or tracks on rack 44, etc.). The movement of rack 44 along one or more rails or guides within dishwasher 10 also permit a user to move rack 44, and therefore spray assembly 34, horizontally between the unextended position (see, e.g., FIG. 5) and various extended positions (see, e.g., FIG. 4).

As shown in FIG. 3, an insert 56 is provided and is positioned with inlet 52 (see FIG. 4). Insert 56 includes a generally planar main portion 62 that has a plurality of apertures 60. As shown in FIG. 4, projections 64, 66, 68 extend from main portion 62 toward valve 80 when insert 56 is positioned with second conduit 50. As discussed in further detail below, projections 64, 66, 68 coordinate with ball 70 to control the flow of fluid to second conduit 50. According to an exemplary embodiment, the distance between adjacent projections corresponds to the vertical height adjustment increments of rack 44 such that for each height at which rack 44 may be positioned, a corresponding projection will be positioned to engage ball 70. According to an exemplary embodiment, projections 64, 66, 68 are spaced approximately 0.75 inches from each other. According to various other exemplary embodiments, the distances between projections 64, 66, 68 may be varied to suit a particular application.

Referring now to FIG. 4, spray assembly 34 is shown in a first or extended position (e.g., disengaged, extended, etc.) according to an exemplary embodiment such that inlet 52 is disengaged from valve 80 (e.g., such that rack 44 is in an extended position or completely removed from dishwasher 10). As shown in FIG. 4, ball 70 is biased by member 72 toward outlet 84 such that ball 70 seals substantially the entire outlet 84 that would otherwise be open and permit fluid to flow. In the configuration shown in FIG. 4, fluid that travels through conduit 40 will travel past ball 70 via a gap 92 between ball 70 and member 72 and/or conduit 40, such that the fluid continues to travel toward the upper spray assembly and little or no fluid exits from outlet 84. Thus, when rack 44 and spray assembly 34 are in an extended position, little or no fluid is permitted to exit from conduit 40 through valve 80 and there is little or no pressure loss within conduit 40 due to fluid exiting valve 80. Furthermore, should rack 44 inadvertently be left in an extended position, or be accidentally "blown off" from the engaged position, valve 80 minimizes the fluid that may escape from conduit 40 and cause unwanted noise, etc.

Referring now to FIG. 5, spray assembly 34 is shown in a second, or unextended position (e.g., retracted, stowed, engaged, etc.) such that conduit 50 engages valve 80 and tub wall 20. As shown in FIG. 5, a surface 58 of conduit 50 is generally parallel with wall 20 in the area of wall 20 that engages conduit 50 such that a reliable seal may be made between conduit 50 and wall 20. According to an exemplary embodiment, surface 58 comprises a compressible sealing portion configured to fluidly seal the interface of conduit 50 and wall 20 such that fluid that enters inlet 52 of conduit 50 continues to spray arm 90 rather than "leaking" into tub 16 through the interface of conduit 50 and wall 20.

As shown in FIG. 5, when conduit 50 engages valve 80, one of projections 64, 66, 68 engages ball 70. In the exemplary embodiment shown in FIG. 5, projection 66, located between projections 64 and 68, engages ball 70. Projection 66 is configured such that as spray assembly 34 is moved toward the unextended position, projection 66 pushes ball 70 upward along surfaces 76, 78 of member 72. With ball 70 in the position shown in FIG. 5, fluid may then travel from conduit 40, through valve 80, and to conduit 50, where it is then directed to spray arm 90. Fluid passes from conduit 40 to outlet 84 through a gap, or opening 94, that is created as ball 70 moves upward along member 72. According to one embodiment, only a portion of the fluid traveling through conduit 40 is directed to conduit 50 such that the remaining fluid continues to travel through conduit 40, for example, to an upper spray assembly. According to another exemplary embodiment, valve 80 may be configured so that substantially all of the fluid traveling through conduit 40 is directed to conduit 50 when spray assembly 34 is in the unextended position shown in FIG. 5.

Figure 6:
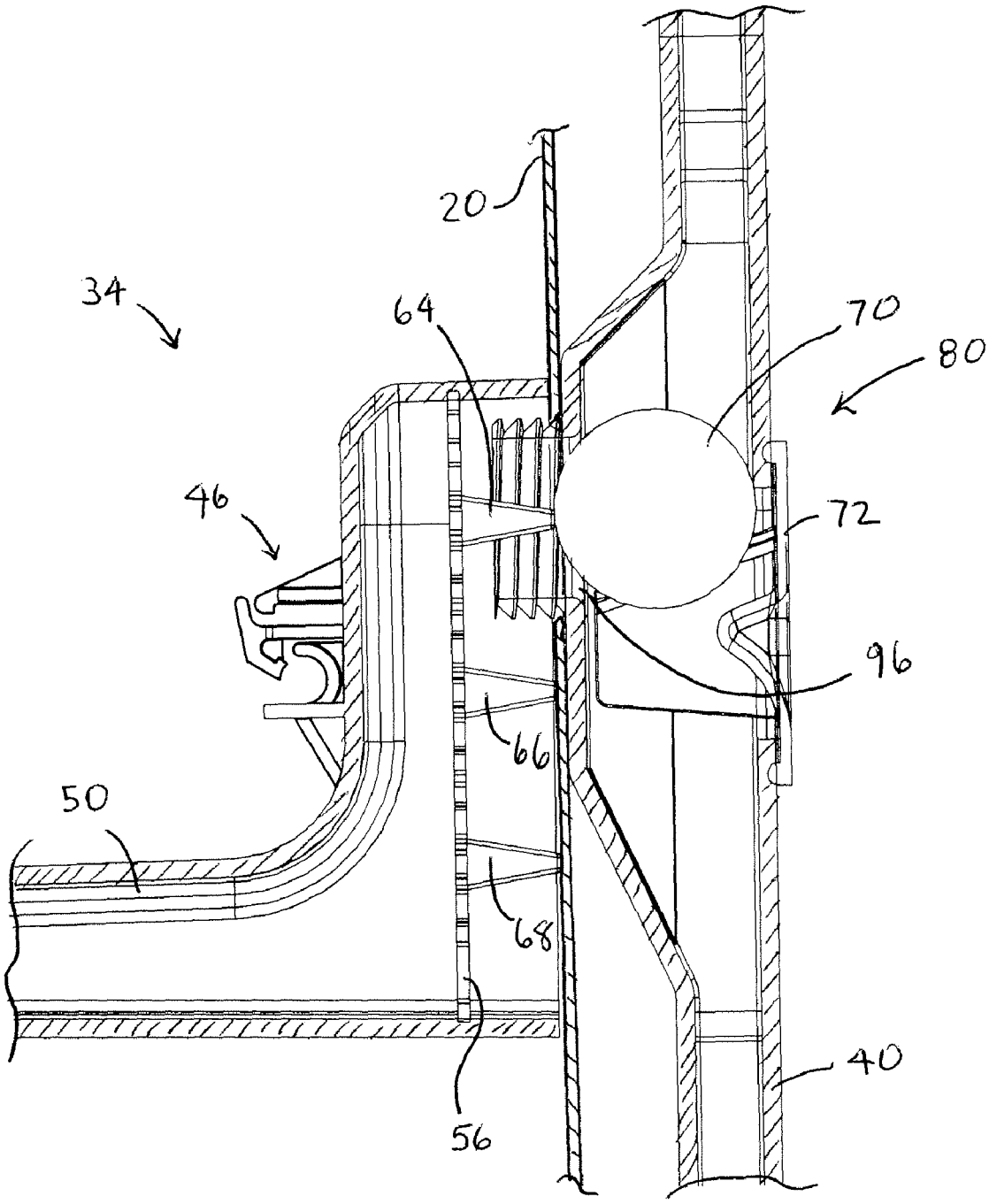
FIG. 6 is a partial cross-sectional view of the fluid supply system shown in FIG. 2 according to an exemplary embodiment.

While FIGS. 4 and 5 illustrate spray assembly 34 being positioned in a middle vertical position such that projection 66 engages ball 70 when spray assembly 34 engages valve 80, it should be understood that spray assembly 34 and valve 80 cooperate in a similar manner to control the flow of fluid through valve 80 when spray assembly 34 is in an upper vertical position (e.g., such that projection 68 engages ball 70), or a lower vertical position (e.g., such that projection 64 engages ball 70). For example, referring to FIG. 6, second conduit 50 is positioned such that upper projection 64 engages ball 70 (i.e., such that rack 44 would be in a lower position relative to that illustrated in FIGS. 4 and 5). Projection 64 and ball 70 cooperate to control the flow of fluid from conduit 40 to conduit 50 in the same manner as described with respect to FIGS. 4 and 5. As shown in FIG. 6, projection 64, spray assembly 34 is in the unextended position such that projection 64 displaces ball 70 to create a gap 96 through which fluid may flow from conduit 40 to conduit 50.

Valve 80 provides many advantages over typical coupling features used in dishwashers or other appliances. For example, when spray assembly 34 is disengaged, valve 80 does not require that any additional caps, plugs, etc. be fastened over outlet 84 to prevent fluid from exiting from outlet 84. Rather, as shown in FIG. 4, ball 70 prevents substantially all of the fluid that passes through conduit 40 from exiting from outlet 84 and directs the water to continue to travel through conduit 40 (e.g., toward another spray assembly, etc.). Accordingly, should a user wish to, for example, place larger items (e.g., large pots or pans, a turkey cooker, etc.) onto the lower rack that would not normally fit if rack 44 were in position, a user may simply remove rack 44 to provide additional space within dishwasher 10 for the larger items without having to be concerned about fluid existing from outlet 84.

Furthermore, according to one embodiment, valve 80 includes only a single outlet 84, whereas many conventional designs require multiple outlets to be positioned along the rear of tub 16, thereby increasing the number of components involved, increasing manufacturing costs, and potentially making maintenance and repair of dishwasher 10 more difficult and expensive.

Further yet, referring back to FIG. 1, according to an exemplary embodiment conduit 40 is routed from pump 30 to the various spray assemblies along or to the exterior of tub 16. This provides advantages over many conventional dishwashers, where the conduits that supply fluid to the spray assemblies are provided within the interior portion of the tub and are often not aesthetically pleasing. For example, by providing conduit 40 to the exterior of tub 16, the space available within tub 16 for the racks, spray assemblies, etc., is maximized. According to another exemplary embodiment, a channel may be formed in the exterior portion of tub 16 to receive conduit 40 such that the "envelope" of space needed to install dishwasher 10 is minimized.

Figure 10:
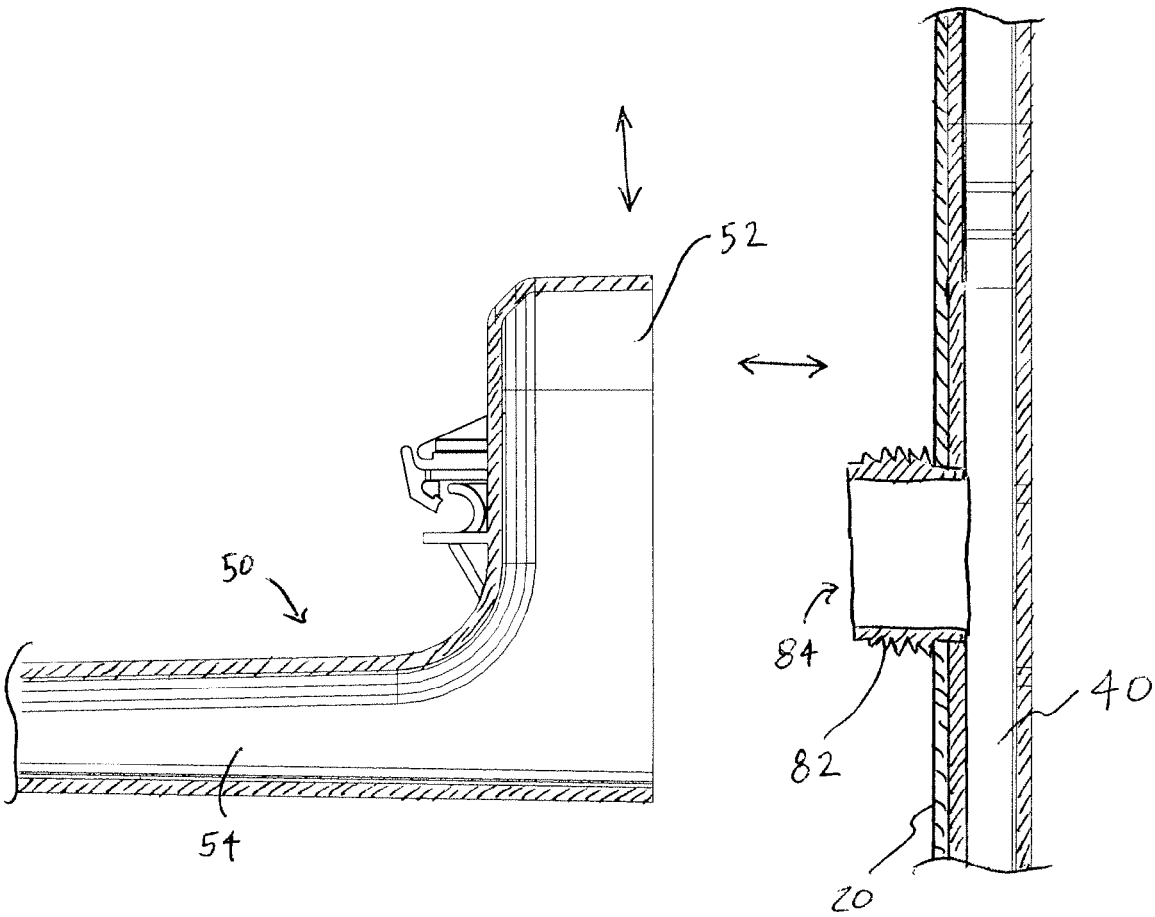
FIG. 10 is a partial cross-sectional view of a fluid supply system according to an exemplary embodiment.

Referring to FIG. 10, according to an exemplary embodiment, second conduit 50 may be provided without insert 56, and first conduit 40 may be provided without member 72 and ball 70, such that first conduit 40 permits fluid to flow to outlet 84 without the use of valve 80 (i.e., as an unrestricted port). As shown in FIG. 10, inlet 52 (e.g., cup or shroud) defines an open cavity (i.e., without values, valve components, etc.) and may be sized such that spray assembly 34 may engage outlet 84 an indeterminate (infinite) number of vertical positions (e.g., 2, 3, 4, etc.) limited be the size of inlet 52 (e.g., the interior vertical dimension). For example, if the vertically adjustable rack can be moved to non-discrete positions, inlet 52 will provide the appropriate interface because it is not limited to a few discrete positions. When spray assembly 34 is not in use, (e.g., rack 44 is removed for a wash cycle) outlet 84 may be closed with a cap member (not shown) to prevent fluid from exiting outlet 84 during use. This embodiment provides a "valveless" interface between first conduit 40 and second conduit 50 capable of non-discrete engagement positions.

Figure 11:
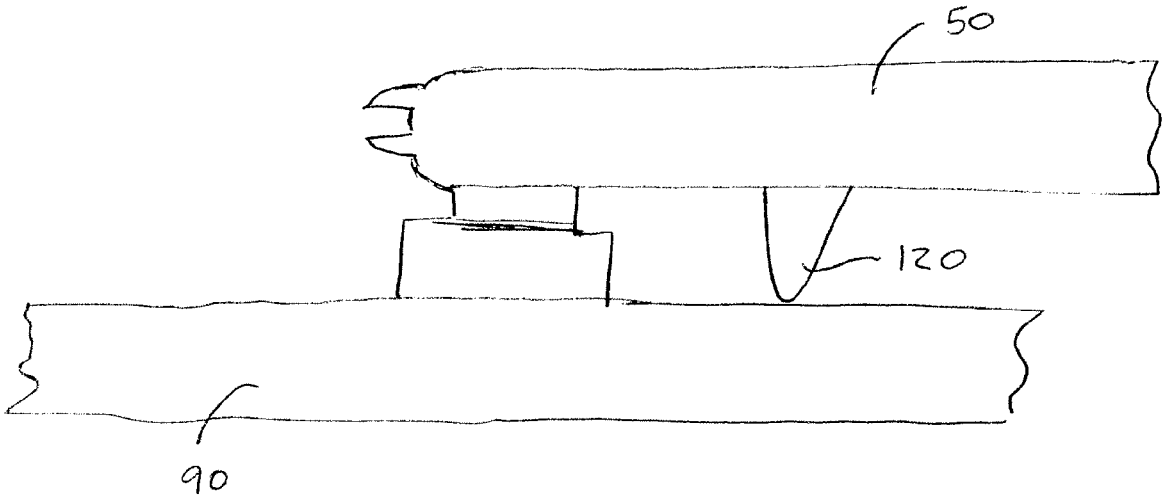
FIG. 11 is a side view of a portion of a fluid delivery system according to an exemplary embodiment.

Referring to FIGS. 8 and 11, second conduit 50 may be provided with a guide member 120 (a pin, extension, guide, etc.) configured to assist in maintaining spray arm 90 in a level (e.g., horizontal) position during rotation of spray arm 90. As spray arm 90 rotates, guide member 120 inhibits or prevents undesired tilting of spray arm 90 by maintaining a substantially constant minimum distance between the top of spray arm 90 and the bottom of second conduit 50. According to an exemplary embodiment, guide member 120 may have a substantially conical or pyramidal shape such that a relatively wider portion is coupled to conduit 50 and a relatively narrower portion extends toward spray arm 90. Guide member 120 may be integrally formed with conduit 50 or provided as a separate member that is coupled to conduit 50 using any suitable means. According to an exemplary embodiment, guide member is made from a polymer material.

Figure 12:
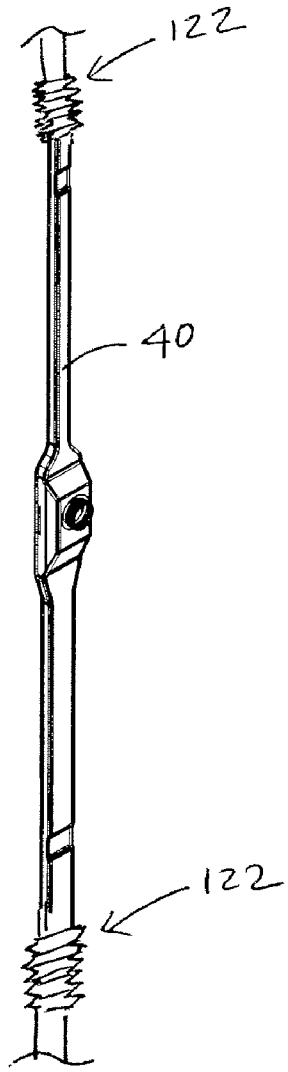
FIG. 12 is a perspective view of a portion of a conduit according to an exemplary embodiment.
Figure 13:
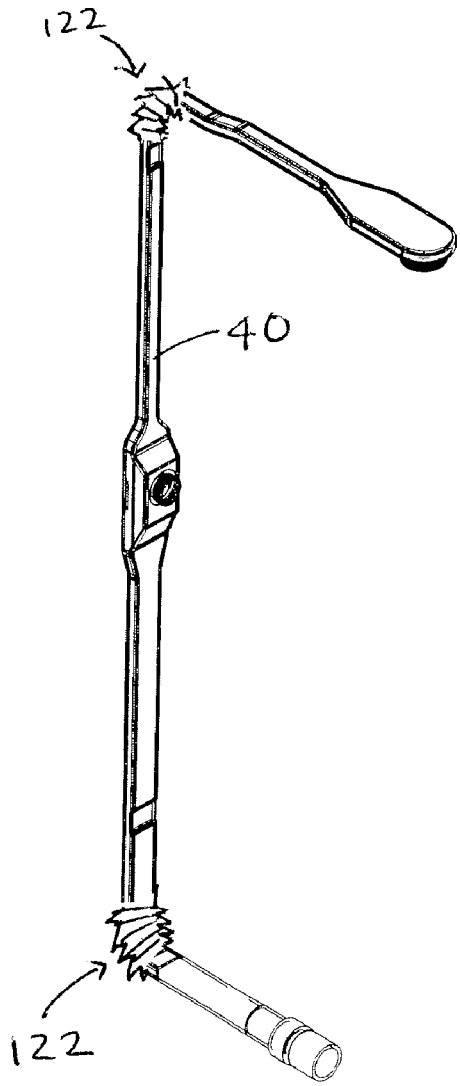
FIG. 13 is a perspective view of a portion of a conduit according to an exemplary embodiment.

Referring now to FIGS. 12 and 13, conduit 40 is shown according to an exemplary embodiment. As shown in FIG. 12, conduit 40 may include one or more flexible portions 122 (bendable portions, corrugated portions, fluted, pleated, etc.). According to an exemplary embodiment, conduit 40 is blow-molded from a polymer material into a substantially straight conduit with flexible portions 122, as illustrated in FIG. 12. Conduit 40 may then be bent (formed, flexed mould, etc.) into its final position as shown in FIG. 13. Forming conduit 40 into an initially straight conduit may provide many advantages over forming an initially bent or curved conduit, including reduced tooling costs, reduced shipping/transportation costs, reduced labor costs and easier installation and/or modification of the blow-molding tooling. Conduit 40 may be bent into its final configuration at any stage (e.g., during assembly onto tub 16, etc.) according to various exemplary embodiments. According to an exemplary embodiment, flexible portions 122 include a number of corrugated sections provided in an accordion-type arrangement that are configured to permit flexing or bending of conduit 40 into a final, desired shape. According to various other exemplary embodiments, flexible portions 122 may include other configurations, shapes, etc.

It is important to note that the construction and arrangement of the dishwasher and fluid supply system as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or other wise varied, and the nature or number of discrete elements or positions may be altered or varied. Also, while this disclosure is generally directed to dishwashers, the teachings contained herein may extend to various other types of devices and appliances. Accordingly, all such modifications are intended to be included within the scope of the present inventions as defined in the appended claims.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

The order or sequence of any process or method steps may be varied or resequenced according to various alternative embodiments. In the claims, any means-plus-function clause is intended to cover the structures described herein as performing the recited function and not only structural equivalents but also equivalent structures. Other substitutions, modifications, changes, and omissions may be made in the design, operating conditions, and arrangement of the exemplary embodiments without departing from the scope of the present inventions as expressed in the appended claims.

What is claimed is:

1. A dishwasher comprising:

a tub formed by a plurality of walls defining an interior and an exterior;

a first conduit coupled to the tub;

a valve coupled to the first conduit;

a rack moveable between an engaged horizontal position and a disengaged horizontal position and moveable between an upper vertical position and a lower vertical position; and a second conduit coupled to the rack;

wherein a first portion of the second conduit is configured to engage the valve when the rack is in the upper vertical position and a second portion of the second conduit is configured to engage the valve when the rack is in the lower vertical position;

wherein the valve permits fluid to flow from the first conduit to the second conduit when the rack is in the engaged position, and wherein the valve does not permit fluid to flow from the first conduit to the interior when the rack is in the disengaged position;

wherein the valve comprises an outlet and a ball that substantially seals the outlet when the rack is in the disengaged horizontal position; and wherein the second conduit comprises a shroud containing a first projection and a second projection, wherein the shroud is configured to enclose at least a portion of the valve when the rack is in the engaged horizontal position; and wherein the first projection and the second projection are configured to displace the ball out of engagement with the outlet when the rack is in the engaged horizontal position.

2. The dishwasher of claim 1, wherein the first conduit and the valve are located at the exterior of the tub.

3. The dishwasher of claim 1, wherein the valve further comprises an incline that supports the ball.

4. The dishwasher of claim 3, wherein the incline comprises a curved surface.

5. The dishwasher of claim 3, wherein the incline is integrally formed with the first conduit.

6. The dishwasher of claim 1, further comprising:

an insert coupled to the second conduit and located at least partially within the shroud;

wherein the first projection extends from the insert and the second projection extends from the insert.

7. The dishwasher of claim 6, wherein the insert further comprises a plurality of apertures configured to permit fluid to flow from the first conduit to the second conduit.

8. A fluid supply system for an appliance comprising:

a conduit having an outlet; and a spray assembly having an inlet comprising at least a first projection and a second projection;

wherein the inlet is configured to engage the outlet at the first projection of the inlet when the spray assembly is in an upper position and at the second projection of the inlet when the spray assembly is in a lower position;

wherein the outlet permits fluid to flow from the outlet to the inlet when the inlet engages the outlet; and wherein the outlet does not permit fluid to flow from the outlet when the inlet is disengaged from the outlet.

9. The fluid supply system of claim 8, further comprising:

a tub having an exterior; wherein the conduit is located on the exterior of the tub.

10. The fluid supply system of claim 8, wherein the outlet further comprises a ball member and an inclined surface to support the ball member, and wherein one of the first and second projections engages the ball member when the inlet engages the outlet.

11. The fluid supply system of claim 10, wherein the inclined surface is integrally formed with the conduit.

12. The fluid supply system of claim 8, further comprising a second spray member and a third spray member both coupled to the conduit, the spray assembly being located between the second spray member and the third spray member.

13. An appliance comprising:

a tub having an interior;

a conduit coupled to the tub, the conduit having an outlet and a ball that is moveable between a first position and a second position such that the ball permits a fluid to exit the outlet only when the ball is in the second position; and a spray member for providing the fluid to the interior and having an inlet and being removably coupled with the outlet to receive the fluid from the outlet, the spray member including a first projection and a second projection that selectively interface with the ball such that the ball is in the first position when the inlet is not coupled with the outlet, and the ball is moved to the second position when the inlet is coupled with the outlet.

14. The appliance of claim 13, further comprising:

a rack adjustable between at least a first position and a second position and coupled to the spray member; wherein the first projection is configured to interface with the ball when the rack is in the first position and the second projection is configured to interface with the ball when the rack is in the second position.

15. The appliance of claim 13, wherein the spray member includes an insert comprising the first projection and the second projection, the insert further comprising a plurality of apertures configured to permit the fluid to flow from the conduit through the insert and to the spray member.

16. The appliance of claim 13, wherein the conduit is coupled to an inclined surface configured to support the ball.

17. The appliance of claim 13, wherein the conduit is located to the exterior of the tub.

18. A dishwasher comprising:

a tub;

a wash pump coupled to the tub;

a rack moveable between a first horizontal position and a second horizontal position;

a spray arm assembly removably coupled to the rack and comprising a spray arm and a first conduit; and a second conduit located at the exterior of the tub that fluidly couples the wash pump to the spray arm assembly when the rack is in the second horizontal position;

wherein the first conduit includes a first attachment feature that engages a first tine on a rear side of the rack and a second attachment feature that engages a second tine on the bottom side of the rack; and wherein the first conduit comprises an inlet defining an open cavity and the second conduit comprises an unrestricted port to provide a valveless interface between the first conduit and the second conduit capable of non-discrete engagement positions.

19. The dishwasher of claim 18, wherein the first attachment feature comprises a hook and catch member that provides a snap fit engagement to the first tine, and the second attachment feature comprises a recess that engages the second tine.

20. The dishwasher of claim 18, further comprising a guide member configured to assist in maintaining the spray arm in a generally horizontal orientation during rotation.

21. The dishwasher of claim 20, wherein the guide member is a projection extending from a bottom surface of the first conduit.

* * * * *